United States Patent [19]

Hubbard et al.

[11] 4,067,649

[45] Jan. 10, 1978

[54] METHOD AND APPARATUS FOR CONTROLLING THE DUPLEX COPY MODE IN AN ELECTROSTATIC COPYING DEVICE

[75] Inventors: James Henry Hubbard, Boulder; Ralph Joseph LeClere, Longmont; Thomas Travis Underhill, Boulder, all of Colo.

[73] Assignee: International Business Machines Corporation, Armonk, N.Y.

[21] Appl. No.: 651,883

[22] Filed: Jan. 23, 1976

[51] Int. Cl.[2] ..... G03G 15/00

[52] U.S. Cl. ..... 355/14; 96/1 R; 271/9; 355/3 SH

[58] Field of Search ..... 355/3 R, 3 SH, 14; 271/3.1, 9, 258, 259; 96/1 R

[56] References Cited

U.S. PATENT DOCUMENTS

| | | | |
|---|---|---|---|
| 3,615,129 | 10/1971 | Drawe et al. | 355/3 R |
| 3,645,615 | 2/1972 | Spear | 355/3 R |
| 3,900,192 | 8/1975 | Gibson | 271/3.1 |
| 3,907,283 | 9/1975 | Miller | 271/258 |
| 3,944,359 | 3/1976 | Fisk et al. | 355/14 |
| 3,989,371 | 11/1976 | Valentine | 355/14 |

*Primary Examiner*—Fred L. Braun
*Attorney, Agent, or Firm*—Herbert F. Somermeyer

[57] ABSTRACT

A document reproduction machine operates either in a simplex mode (each copy has an image only on one side) or in a duplex mode (copies have images on both sides). In the duplex mode, an interim storage unit stores partially completed copies (only one side of the duplex copies have an image). A second copy run completes the duplexed copy production. For an odd number of originals, at the end of a duplex copy run, the last-produced copy set resides in the interim storage unit. In one aspect of the disclosure, in response to an indication of the end of a duplex run, the machine automatically transfers the last-produced copy set from the interim storage unit to a copy output unit. In another aspect of the disclosure, any change between simplex and duplex modes actuates the machine to empty the interim storage unit.

32 Claims, 1 Drawing Figure

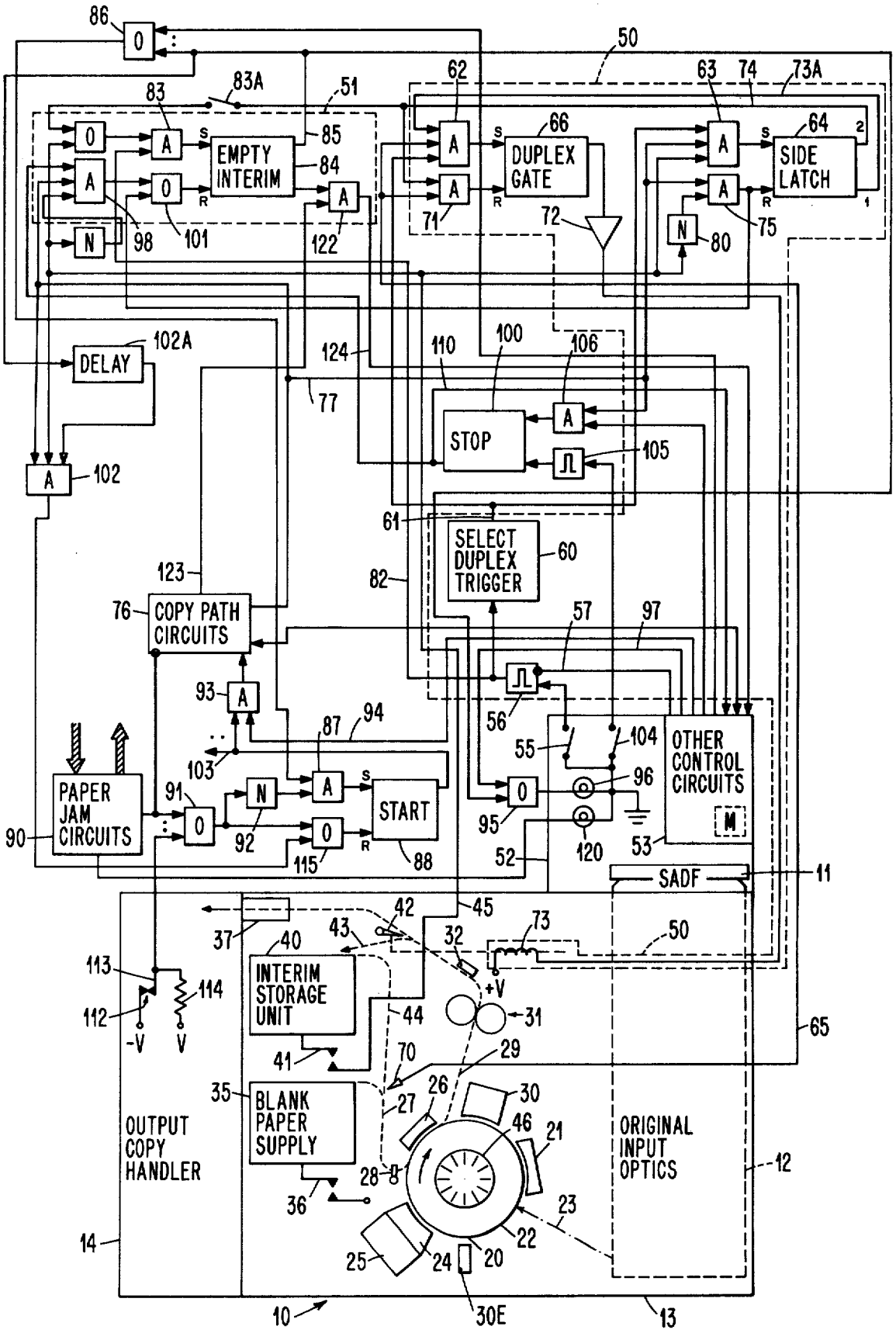
EMPTY INTERIM
DUPLEX GATE
SIDE LATCH
DELAY
STOP
SELECT DUPLEX TRIGGER
COPY PATH CIRCUITS
PAPER JAM CIRCUITS
START
OTHER CONTROL CIRCUITS
SADF
INTERIM STORAGE UNIT
BLANK PAPER SUPPLY
OUTPUT COPY HANDLER
ORIGINAL INPUT OPTICS

METHOD AND APPARATUS FOR CONTROLLING THE DUPLEX COPY MODE IN AN ELECTROSTATIC COPYING DEVICE

DOCUMENTS INCORPORATED BY REFERENCE

Andrews et al U.S. Pat. No. 4,003,569 shows a monitoring means for detecting and indicating no copies are being transported in a copy transport path.

Berlier et al U.S. Pat. No. 3,588,242 shows a counter controlled photoconductor advance mechanism.

BACKGROUND OF THE INVENTION

The invention relates to document reproduction machines, in particular to those document reproduction machines operable in a duplex mode.

Prior document reproduction machines, such as convenience copiers, have operated in both a simplex and duplex mode. Most copiers operable in both modes often have an interim storage unit termed a "duplex" tray or "auxiliary" tray for temporarily storing the partially reproduced copies; i.e., those copies have an image impressed on but one side. Upon completion of the production of the single-image interim duplex copies, a second original, or the opposite side of an original, is placed upon a platen for reproduction on the second side of the partially reproduced copies. Then, a second run of the copier is initiated wherein the copies in the interim storage unit are transferred through the reproduction process for receiving an image on the second-side. Then, the completed duplex copies are transferred to an output unit which may include a single tray or a collator. Accordingly, duplex copying machines have provisions for directing copies from the copy reproduction process to either the output portion or to the interim storage unit (for receiving the partially reproduced copies). All copies of one original image are termed a copy set. It is desired to have all copy sets in the output portion.

In producing two-sided copies in the duplex mode, a problem arises when there is an odd number of images to be copied. In such an instance, the last copy set of the duplex run resides in the interim storage unit and not in the normal output portion of the machine. Of course, if there is an even number of images, then all copy sets will be in the output portion.

Prior machines have permitted the last copy set to remain in the interim storage means requiring an operator to open the machine and remove the last copy set from the machine and then combine that last copy set with the previous copy sets already in the output portion. The above operator action is quite simple if the machine is in a noncollate mode or does not have a collator. However, if each copy set has up to 100 copies and a collator is in the output portion, then the operator must hand collate all 100 copies of the last copy set with the previously automatically collated copy sets.

To avoid the hand collation, it is possible in some copy machine to initiate an additional copy run whereat the reverse side of the platen is copied on the back side of the copies in the last copy set. This may result in pictures of transport wheels and the like being impressed upon the back side of the last copy set, which may be objectionable in some copy production. This action may also result in graying or other marks being imposed on the back side of the copies in the last copy set. In those machines charging the user by the number of images produced, the latter requires an additional charge for completing the run automatically. That is, the user is charged for running the last copy set through the machine even though the user desires no image to be put on the back side of the copies of the last copy set.

All of the above actions in handling an odd number original duplex copy run require thoughtful action on the part of the operator. For convenience purposes, it is desirable to minimize such action by the operator by making the document reproduction machine as fully automatic as possible. Such ease of operation facilitates greater throughput of the document reproduction machine.

SUMMARY OF THE INVENTION

It is an object of the invention to provide a document reproduction machine having a substantially automatic operation for duplex copying of any number of original documents.

In accordance with one aspect of the invention, the document reproduction machine has a document reproduction portion which includes means for transporting paper therethrough for impressing images thereon to create copies of originals to be reproduced. The machine has a duplex or interim storage means for receiving copies in the duplex mode having but one image impressed thereon. When an odd number of originals is reproduced during a duplex mode, means indicate an end of a duplex copy run, while other means indicate there are copies in said interim storage means. The machine has automatic control means responsive to the latter two indications for automatically transferring the last copy set in the interim storage means to the exit portion, which may be a tray, collator, and the like.

In another aspect of the invention, rather than indicating the end of a duplex copy run, a machine may have a simplex and duplex mode of operation. Any change in the machine modes between simplex and duplex with copies in the interim storage means results in those copies being transferred automatically to the output unit of the document reproduction machine.

In a preferred form of the invention, for reduced cost, it is desired that the last copy set from the interim storage means transfer through the document reproduction portion to the output portion. During such transfer, the document reproduction action is inhibited for ensuring that the back side of the single-imaged duplex copies has no unintended marks thereon. Also, it is preferred that such transferring inhibit operation of any billing meters.

In another aspect of the invention, the automatic transferring of the single-imaged duplex copy set can be interrupted without adverse affects. Further, manual over-ride for stopping the transferring is provided.

The foregoing and other objects, features, and advantages of the invention will become apparent from the following more particular description of a preferred embodiment thereof, as illustrated in the accompanying drawing.

THE DRAWING

The single FIGURE is a diagrammatic showing of a document reproduction machine incorporating the teachings of the present invention.

DETAILED DESCRIPTION

Referring now more particularly to the single FIGURE, a document reproduction machine 10 has a semi-automatic document feed (SADF) 11 for transporting originals past an original input optic portion 12. The SADF 11 has a platen (not shown) scanned by optics (not shown) within portion 12 for transferring images of the original documents to document reproduction portion 13 of the document reproduction machine. The images transmitted to portion 13 are impressed upon paper and supplied as copies to output copy handler 14, which may be a bin, collator, and the like. In accordance with the invention, all copies are available to the operator through the output copy handler, whether in the simplex mode, duplex mode, and whether or not the number of originals to be reproduced has an odd or even number.

When operating in a duplex mode, portion 13 operates in a succession of single-image copy runs, each single-image run consisting of a plurality of copy production cycles, each cycle represented by the passage of an image area on photoconductor transfer member 20 past image-receiving area 22 which receives the image to be reproduced from portion 12, as indicated by dashed line arrow 23. During each single-image run, the operator controls of the document reproduction machine, except for the stop button, are disengaged. At the end of a single-image run, i.e., the transfer of one image to a plurality of copies, operator selections are enabled. Also, insertion of an original document into SADF 11 causes it to be automatically transferred to the platen (not shown) for being scanned by original input optics 12. Hence, for each two-image duplex copy transported to the output copy handler 14, there are two successive single-image runs by document reproduction portion 13. A duplex copy run consists of a succession of such single-image runs.

Before proceeding further with the description of the invention, the operation of document reproduction portion 13 is described as a constructed embodiment of a so-called xerographic document reproduction machine. The photoconductor member 20 rotates in the direction of the arrow past a plurality of xerographic processing stations. The first station in xerographic reproduction process is charging station 21 which imposes either a positive or negative electrostatic charge on the surface of photoconductor member 20. It is preferred that this charge be a uniform electrostatic charge over a uniform photoconductor surface. Such charging is done in the absence of light such that projected images, indicated by dash line arrow 23, alter the electrostatic charge on the photoconductor member in preparation for image developing and transferring. Exposure in area 22 exposes the photoconductor surface which was charged to a bright light by the image projected by original input optics 12. Light reflected from the original document discharges the areas on the photoconductor surface in accordance with lightness. With minimal light reflected from the dark or printed areas of the original document, there is no corresponding discharge. As a result, an electrostatic charge remains in those areas of the photoconductive surface corresponding to the dark or printed areas of the original document in SADF 11. This charge pattern is termed a "latent" image on the photoconductive surface. Interimage erase lamp 30E discharges photoconductor member 20 outside defined image areas.

The next xerographic station is the developer 24 which receives toner (ink) laden beads from toner supply 25 for being deposited on the photoconductive surface having charged areas. The developer station receives the toner with an electrostatic charge of polarity opposite to that of the charged areas of the photoconductive surface. Accordingly, the toner particles adhere electrostatically to the charged areas, but do not adhere to the discharged areas. Hence, the photoconductive surface, after leaving station 24, has a toned image corresponding to the dark and light areas of the original documents of SADF 11.

Next, the latent image is transferred to copy paper in transfer station 26. The paper is brought to the station 26 from an input paper path portion 27 via synchronizing input gate 28, thence through transfer station 26 and, finally, along paper path 29. The copy paper is brought into contact with the toned image on the photoconductive surface resulting in a transfer of the toner to the copy paper. After such transfer, the sheet of copy paper is stripped from the photoconductive surface for transport along path 29. Next, the paper has the image fused thereon in fusing station 31 creating a permanent image on the copy paper. Such copy paper receives electrostatic charges which have an adverse affect on copy handling. Accordingly, the copy paper after fusing is electrically discharged at station 32 before transfer to output portions, as later described.

Returning now to the photoconductor member 20, after the image area leaves transfer station 26, there is a certain amount of residual toner on the photoconductive surface. Accordingly, cleaner station 30 has a rotating cleaning brush to remove the residual toner for cleaning the image area in preparation for receiving the next image projected by original input optics 12. The cycle then repeats by charging the just-cleaned image area by charging station 21.

The production of simplex copies or the first side of duplexing copies by portion 13 includes transferring a blank sheet of paper from blank paper supply 35, thence to transfer station 26, fuser 31, and, when in the simplex mode, to aligner 37 directly to the output copy handler 14. When handler 14 consists of a copy receiving tray (not shown), aligner 37 may be dispensed with. Blank paper supply 35 has an empty sensing switch 36 which inhibits operation of portion 13 in a known manner whenever supply 35 is out of paper.

When in the duplex mode, duplex diversion gate 42 is actuated by the duplex controlling circuits 50 to the upward position for deflecting single-image copies to travel over path 43 to the interim storage unit 40. Here, the partially produced duplex copies (image on one side only) reside waiting for the next subsequent single-image run in which the copies receive the second image. In the next-successive single-image run, initiated by inserting a document into SADF 11, the copies are removed one at a time from the interim storage unit 40, transported over path 44, thence to path 27 for receiving a second image, as previously described. The two-imaged duplex copies are then transferred through aligner 37 into output copy handler 14. For purposes of the present invention, a switch 41 of interim storage unit 40 detects whether or not there are any copies or paper in interim storage unit 40. If so, an activating signal is supplied over line 45 to duplex control circuits 50 and to duplex run terminating circuits 51. Circuits 51, as will be described, cause the automatic transfer of the single image duplex copies from interim storage unit 40 through paths 27 and 29, thence to the output copy handler 14 without receiving an image in transfer station 26.

The document reproduction machine has a control panel 52 having a plurality of lights and switches (most not shown), as well as a set of other control circuits 53 which operate the entire machine synchronously with respect to the movement of the image areas of photoconductor member 20. Billing meter M of circuits 53 counts images processed for billing purposes. For example, paper release gate 28 is actuated synchronously with the image areas moving past developer station 24. Such controls are well known in the art and are not described here for purposes of brevity.

Before describing the control of the interim storage unit by circuits incorporating the present invention, the duplex control circuits 50 and their operation in controlling the document reproduction machine in the duplex mode are first described. Duplex mode selecting switch 55 supplies ground reference potential to noise-rejecting type of pulse-forming circuit 56. Circuit 56 may be inhibited during a single-image run by a signal received over line 57 from other control circuits 53. Pulse former circuit 56 supplies its output pulse indicating that switch 55 has been actuated to trigger select duplex trigger 60 to its opposite state. Accordingly, each closure of switch 55 switches the document reproduction machine between simplex and duplex modes. That is, trigger 60 being set to a first state indicates the duplex reproduction mode; and being reset to a second state indicates a simplex reproduction mode. The duplex reproduction mode is indicated by an active signal traveling over line 61, to AND circuits 62 and 63. AND circuit 62 responds to the duplex mode signal on line 61, to a side latch =1 signal from latch 64, and to a blank sheet picked signal from switch 70 on line 65 to actuate duplex gate latch 66 to the set state.

When in the duplex mode, duplex gate latch 66 is set to the active condition. The latch 66 supplies its active signal through amplifier-driver 72 for actuating solenoid 73 which pulls gate 42 to the upward position. In the upward position, gate 42 deflects the copies received from path 29 to path 43 as previously described. Gate 42 is alternately actuated for first directing copies to interim storage unit 40 (first single-image run) and then to output aligner 37 (second single-image run) for transmittal to output copier handler 14. The alternating action is achieved through side latch 64 which supplies the side-1 indicating signal over line 73A and side-2 indicating signal over line 74 to AND circuits 62 and 71, respectively. Side latch 64 is actuated between the set and reset states (side-2 and side-1, respectively) by AND circuits 63, 75. Side-1 is indicated by ANd circuit 75 responding to copy path circuits 76 indicating that the copy path is clear, That is, paths 27, 29, and the indicated dash line to output copy handler 14 have no copies. The relationship of copy path circuits 76 to the actual copy path is well known and not shown for purposes of brevity. When the path is clear, circuits 76 supply an active signal over line 77 to both AND circuits 63 and 75. Hence, successive single-image runs in the illustrated copier are nonoverlapping, no limitation thereto intended. Intermediate the single-image runs, side latch 64 can be switched from 1 to 2 and reversed. In this regard, switch 41 sensing that copies are in interim storage unit 40 supplied its activating signal over line 45. If there are no copies in unit 40, NOT circuit 80 supplies an activating signal through AND circuit 75 resetting side latch to copy side-1. That is, in the duplex mode, the interim storage unit has been emptied and the next copy to be made will be a first image on side-1. Similarly, the line 45 signal activates AND circuit 63 to set latch 64 to side-2 state only when select duplex trigger 60 is in the duplex mode. Accordingly, if paper is being temporarily stored in unit 40 and the document reproduction machine is operating in the simplex mode, side latch 64 remains reset to the side-1 indicating state.

At the end of a duplex run, duplex switch 55 is closed for taking the document reproduction machine 10 out of the duplex mode. This action actuates pulse former 56 to supply a pulse triggering duplex trigger 60 to the simplex indicating state. The pulse from former 56 also travels to the circuits 51 for emptying the interim storage unit 40 in the event an odd number of images were to be reproduced in the duplex mode. The line 82 pulse samples AND circuit 83; and if there are copies in interim storage unit 40 as indicated by switch 41 being closed, AND circuit 83 sets empty interim latch 84 to the active condition. This active condition actuates circuits for emptying interim storage unit 40. The active signal from latch 84 goes over line 85, then through OR circuit 86 for passing through AND circuit 87, thence setting start latch 88. Start latch 88 being set causes the document reproduction machine 10 to initiate a single-image run. The AND circuit 87 is further responsive to certain error conditions being absent for setting start latch 88. Additionally, a timing pulse (not shown) from other control circuits 53 may time the setting of start latch 88 in a synchronous manner. The error circuits, which are a condition precedent to setting start latch 88, include paper jam circuits 90 not indicating a jam and other error detectors (not shown). OR circuit 91 combines all of the error-indicating signals for resetting start latch 88 for stopping document reproduction machine 10. NOT circuit 92 takes the output of OR circuit 91 and activates AND circuit 87 whenever all error conditions are absent.

Start circuit 88 initiates operation of the machine via AND circuit 93. AND circuit 93 is jointly responsive to the start latch 88, plus other conditions (not shown), and a timing pulse received over line 94 from other control circuits 53 for actuating copy path circuits 76. Copy path circuits 76, in turn, actuate the mechanism of document reproduction portion 13 in a known manner for transferring copies from interim storage unit 40 through the paper paths 27, 29. It will be remembered that at this time side latch 64 is set to the side-2 indicating condition, with the active signal on line 74 moving gate 42 to the downward position, as well as actuating circuits (not shown) for removing the copies from interim storage unit 40 through path 44, thence to path 27. Such latter operations are in known machines and are not described for that reason.

Further, empty interim latch 84 active signal on line 85 travels to OR circuit 95 for lighting standby lamp 96 in control panel 52. OR circuit 95 receives inputs over line 97 from other control circuits 53 for also lighting standby lamp 96 during other operating conditions in which copies are not to be made in machine 10. Lamp 96 being lit indicates to the operator that the document reproduction machine 10 is not available for selection or for copy production. In this manner, the emptying of storage unit 40 interrupts the normal day-to-day copy production until all the copies in unit 40 have been transferred as above described. The transfer is complete when switch 41 senses no more copies in interim storage unit 40. At this time, the signal on line 45 resets side latch 64 to the active condition after copy path circuits 76 indicate the copy path is clear. Also, copy path circuits 76 supply the copy path clear signal to AND circuit 98 of control circuits 51. AND circuit 98 responds to this signal, plus a stop latch 100 being set to the active condition (as will be later described) to supply a resetting pulse through OR circuit 101 for resetting empty interim latch 84. This action removes the activating signal from AND circuit 87, as well as extinguishing the standby lamp 96. The start latch 88 is then reset to the inactive condition by AND circuit 102 jointly responding to empty interim latch 84 being set, the line 45 signal being active, and the line 77 signal being active. Since latch 84 is reset long before start latch 88, delay circuit 102A maintains an active signal for AND 102. Delay 102A may be a latch set with latch 84 and reset when start latch 88 is reset. The start latch 88 being reset removes activating signals flowing from start latch 88 to other control circuits 53 as indicated by arrow 103. The document reproduction machine now may be used in normal day-to-day operations. Of course, the operator must remove the copies from the output copy handler in the event of the document reproduction machine having manual control of that portion.

Stop latch 100 is set to the active condition by stop button 104 actuating pulse former 105. Other inputs to the stop latch 100 (not shown) include activating signals from the paper jam circuits and the like. Stop latch 100 is reset by AND circuit 106 responding to timing signals from other control circuits 53, and to the line 77 signal from copy path circuits 76 indicating the copy path is clear, such as shown in U.S. Pat. No. 4,003,569. The latch 100 signal also flows over line 110 to other control circuits 53 for utilization in controlling various portions of the document reproduction machine not pertinent to the present invention.

In the event document reproduction machine 10 is in a noncollate mode, i.e., a collator in output copy handler 14 is not being used, and a single bin receives all the copies, it can occur that the number of copies produced exceeds the handling capacity of the bin (not shown) in the output copy handler. Accordingly, to avoid paper jam problems, when the bin becomes full the transfer from interim storage unit 40 to the output copy handler must be interrupted. An output bin (not shown) has a scale for weighing the copies in the output bin. This scale can consist of the copy bin being pivoted at one end and being spring urged upwardly at the opposite end. At the spring-urged end, a switch 112 is urged from a normally closed (NC) position to an open position. This contact opening signifies that the output bin is full and acts as an interrupt control for interrupting copy production. Switch 112 has one contact connected to a $-V$ supply and a second contact at 113 connected through a resistor 114 to a $+V$ supply. When the contacts are closed, the contact 113 is at a relatively negative potential, thereby providing no actuating signal through OR circuit 91. However, upon the opening of the NC contacts 112, a relatively positive signal flows through OR circuit 91, thence OR circuit 115 resetting start latch 88 for interrupting copy production. As previously described, resetting start latch 88 interrupts the document reproduction machine such that no more blank paper is provided from the interim storage unit 40 to the paper paths 27 and 29. Upon removal of the copies from the bin, switch 112 contacts again close, removing the resetting signal from start latch 88. At this time, NOT circuit 92 and the outer signal from OR circuit 86 again actuate AND circuit 87 setting start latch 88. At this time, the transfer from interim storage unit 40 through the paper path 27, 29, through the aligner 37, and through the output copy handler 14 automatically restarts. This action, of course, can be repeated several times depending on the relative capacities of the interim storage unit 40 and the output copy handler 14. Since switch 41 indicates there are still copies in interim storage unit 40, line 45 signal continues to indicate copies in the storage unit, thereby inhibiting resetting the previously described circuits 51, keeping standby lamp 96 illuminated. In case of a paper jam, paper jam circuits 90 supply an activating signal for illuminating clear paper path lamp 120. In such a situation, the paper jam circuits 90 also reset start latch 88 causing interruption of the transfer of copies from interim storage unit 40 to output copy handler 14. Clearing the jam and re-establishing the machine in normal operating condition automatically restarts the transfer of copies from unit 40 to handler 14.

The transfer of the last copy set through paths 27, 29 exposes all of the single image duplex copies to transfer station 26. Accordingly, action should be taken to prevent inadvertent transfer of images from photoconductor member 20 to the copies being transferred. To this end, the copy reproducing process is inhibited while transferring the last copy set to handler 14 from unit 40. This inhibition is achieved in circuits 51. AND circuit 122 responds to the empty interim latch 84 being reset (the last copy set is not being transferred), and a copy path circuit 76 signal on line 123 indicating that the copy path is expecting to receive copies to be made or copies are in the path to supply an activating signal over line 124 to other control circuits 53. This line 124 activating signal actuates other control circuits 53 to drive a machine billing meter M and synchronously turn off the interimage erase lamp 30E with respect to photoconductor member 20 rotation. During the empty interim storage no-image run, these functions are inhibited such that interimage erase lamp 30E is on, continuously erasing the photoconductor member 20 ensuring that the surface of the member 20 is completely discharged. Hence, no toner laden beads adhere to the photoconductor surface keeping the back sides of the last copy set clean. Additionally, charging station 21 and developer station 24 may be deactivated during the empty interim storage no-image cycle.

Billing meter "M" is preferably a solenoid actuated mechanical counter of known design. Such a counter is a cumulative counter actuated as the copy counter of U.S. Pat. No. 3,588,242 is actuated. The line 124 signal of the present application actuates a relay (not shown) via a known relay puller circuit (not shown) to close contacts (not shown) electrically interposed between the copy counter 40 of U.S. Pat. No. 3,588,242 and its illustrated actuating circuits. Such a counter used for billing purposes would not be reset at the end of a copy run.

Another aspect of the invention is the ability of document reproduction machine 10 to recover from a power outage failure. For example, if there was an unintended stoppage for one reason or another, interim storage unit 40 could contain single image duplex copies when the document reproduction machine 10 is repowered. In that event, simplex copying is not involved; hence, no action need be taken with respect to those copies during simplex copying. However, when a duplex mode is selected by an operator, those initial copies in storage unit 40 could cause unintended copies to be included in a reproduced set of copies. Accordingly, when duplex switch 55 is first closed, irrespective of the mode, not only is duplex trigger 60 actuated to the duplex condition, but the line 82 signal activates circuit 51. Circuit 51 being activated and sensing that switch 41 indicates copies in the interim storage unit will initiate the above-described empty interim storage no-image run. This action is considered an automatic preliminary machine conditioning function for enabling duplex operation without error and eliminating possible errors without operator intervention. Accordingly, in accordance with one aspect of the invention, the end of a duplex copy run indicated by the closure of a duplex switch 55 actuates circuits 51 to empty interim storage unit 40. Similarly, selecting of a duplex mode by a switch 55 with copies in the interim storage unit 40 also causes circuit 51 to empty that unit.

While the constructed and illustrated embodiment shows the actuation of a duplex switch 55 as an indicator for end of a run, it is to be understood that the concepts of this invention are also applicable to a more fully automatic machine. In that regard, when in the duplex mode, a document reproduction machine 10 includes an odd/even counter (side latch 64); i.e., each time a copy run is initiated in portion 13, the odd/even counter is triggered between odd and even (side-1, side-2). When the copy run is completed, as may be indicated in an original document handler having an original copy counter, closing switch 83A makes an AND circuit 83 jointly responsive to the odd/even indicator 64, and the original document handler (such as indicated by closure of switch 55) to initiate circuit 51 in the same manner that the closure of switch 55 initiated circuit 51, as above described. In view of the wide variety of logic circuits available and design choices available to aid document reproduction machine designers, it should be noted that the appearance of many implementations of the present invention can take diverse forms without departing from the true scope of the invention. Another example is that a partial copy counter may replace or supplement sensing switch 41 for indicating copies in interim storage 40.

While the invention has been particularly shown and described with reference to a preferred embodiment thereof, it will be understood by those skilled in the art that various changes in form and detail may be made therein without departing from the spirit and scope of the invention.

What is claimed is:

1. A document reproduction machine having a duplex copy production mode, reproduction means having copy path means for transferring images to a copy sheet being transported therethrough, duplex copy interim storage means, duplex control means to direct single image duplex copies to said interim storage means and completed duplex copies to an output portion of said machine, the improvement including in combination:

first means indicating end of duplex copy production run; and duplex run terminating means being responsive to said first indicating means to transport said single image duplex copies from said interim storage means to said output portion.

2. The machine set forth in claim 1 further including duplex run terminating auxiliary control means responsive to said duplex run terminating means to inhibit said reproduction means from transferring images to copy sheets being transported therethrough.

3. The machine set forth in claim 2 further including interrupt control means inhibiting alteration other than stopping of said machine operation instituted by said duplex run termination means.

4. The machine set forth in claim 3 further including machine interruption means for interrupting the operation instituted by said duplex run terminating means and said interrupt control means including means for restarting said machine upon termination of said interruption without additional alteration of said machine operation.

5. The machine set forth in claim 1 further including interim means indicating single image duplex copies in said interim storage means; and said duplex run terminating means being further responsive to said interim indicating means to transport said single image duplex copies from said interim storage means to said output portion.

6. The machine set forth in claim 5 wherein said interim indicating means includes sensing means for sensing presence of one or more copies in said interim storage means.

7. The machine set forth in claim 5 wherein said duplex control means further includes side indicating means for indicating first and second image copy production; and means supplying said second image copy indication to said duplex run terminating means for enabling said transport of said single-image duplex copies from said interim storage means.

8. The machine set forth in claim 5 wherein said machine is operable in either a simplex copy production mode or said duplex copy production mode, further including in combination:

counter means indicating in which of said copy production modes said machine is operating;

mode control means actuating said counter means to switch between said mode indications;

said first indicating means being said mode control means when said counter means indicates said duplex copy production mode, said mode control means actuating said counter means to a non-duplex mode as an end of a duplex copy production run; and said duplex run terminating means also being responsive to said mode control means actuating said counter means to said duplex mode to transport said single-image duplex copies.

9. The machine set forth in claim 8 further including:

copy path circuits monitoring said copy path means for no copies being transported therethrough; and said duplex run terminating means being responsive to said copy path circuits for terminating said transport from said interim storage means.

10. The machine set forth in claim 8 further including reset means responsive to said interim indicating means indicating no copies in said interim storage means for resetting said duplex run terminating means to terminate said transport from said interim storage means.

11. The machine set forth in claim 1 having a copy count actuated billing meter and further including auxiliary control means in said duplex run terminating means inhibiting said billing meter from tallying copy counts.

12. The machine set forth in claim 1 having a plurality of xerographic process stations including a transfer station, an inter-image erase station having a turn-off cycle, an image station, a cleaning station, and a charging station, the improvement further including in combination:

auxiliary control means in said duplex run terminating means for inhibiting said turn-off cycle of said inter-image erase station while permitting operation of at least said cleaning station.

13. A document reproduction machine having a document reproduction path for transporting copies of images being reproduced, a plurality of document reproducing stations disposed along said path, an exit portion in said path, an interim storage means for receiving single-image duplex copies, means for removing said single-image duplex copies one at a time from said interim storage means, an entry portion in said path adapted to receive blank copies from a paper supply and said removed single-image duplex copies, said machine being operable in either one of simplex or duplex modes, the improvement including in combination:

means indicating a copy residing in said interim storage means;

means indicating a change between said machine modes; and means jointly responsive to both said indicating means to actuate said document reproduction path to transport said copy from said interim storage means into said exit portion.

14. The machine set forth in claim 13 further including means in said jointly responsive means inhibiting copy production during said transport from said interim storage means during said indications.

15. The machine set forth in claim 13 further including AND means in said jointly responsive means inhibiting operation of predetermined ones of said document reproducing stations during said transport from said interim storage means during said indications.

16. The machine set forth in claim 15 further including an inter-image erase lamp normally turned off during image transfer in a copy production run, the improvement further including:

means connecting said AND means to said inter-image erase lamp for inhibiting turn-off whereby image transfers are inhibited.

17. The machine set forth in claim 15 further including a billing meter, the improvement including means connecting said AND means to said billing meter for inhibiting said meter.

18. A document reproduction machine having a plurality of image processing stations, means including a paper path to transport copies being made past a transfer one of said stations to an exit portion, interim copy storage means in said paper path for storing partially reproduced copies, the improvement including in combination:

means indicating a predetermined machine state relating to duplex copy production; and means responsive to said indication to automatically transfer said partially reproduced copies to said exit portion.

19. The machine set forth in claim 18 further including control means in said responsive means for altering operation of said plurality of processing stations during said automatic transfer for inhibiting transferring an image to said partially reproduced copies during said automatic transfer.

20. The method of operating a document reproduction machine designed to produce double-image duplex copies in a duplex mode, the machine operable in other than said duplex mode, an interim storage unit for storing single-image duplex copies, the steps of:

selecting a mode of operation for said machine;

immediately after said selection, indicating whether or not copy paper resides in said interim storage means — if copies are indicated in said interim storage means, emptying said interim storage by moving copies to an exit portion through a paper path including an image transfer station; and inhibiting image transfers during said emptying.

21. The method set forth in claim 20 further including the steps of:

sensing for copy paper in said interim storage means and supplying said copies remaining indication while said sensing means senses copy paper.

22. The method set forth in claim 20 wherein said selection of a mode includes selection or deselection of said duplex mode.

23. The method of operating a document reproduction machine having an interim storage unit for holding single-image duplex copies when said machine is in a duplex copy production mode;

transporting double-image duplex copies to an exit portion of said machine;

the steps of:

indicating end of a duplex copy production run;

indicating that single-image duplex copies remain in said interim storage unit after the end of said duplex copy production run;

while both said indications are active, transporting said single-image duplex copies to said exit portion; and removing one of said indications to stop said transporting.

24. The method set forth in claim 23 further having the steps of:

inhibiting initiating a new copy production run when said indications are true.

25. The method set forth in claim 24 further including inhibiting image transfers when both said indications are true; and said transporting of single-image duplex copies includes transporting such copies through an image transfer station.

26. The method set forth in claim 23 further including sensing for paper in said interim storage unit and supplying said copies remaining indication only as long as said sensing step senses paper therein; and inhibiting image transfers in said machine until said copies remaining indication is removed.

27. The method set forth in claim 26 further including the step of inhibiting initiation of a new copy production run during said copies remaining indication only in concurrence in said end of run indication.

28. The method set forth in claim 24 further including deselecting said duplex mode at said end of run indication.

29. The method set forth in claim 24 further including the steps of:

removing said end of run indication;

memorizing that said end of run indication occurred;

indicating when said interim storage unit is empty; and erasing said memorization after said interim storage unit is empty.

30. The method set forth in claim 29 further including the step of inhibiting predetermined machine functions during said memorization.

31. A copy production machine having an image input section, a copy production portion and an output portion, a copy sheet transport means beginning in said copy production portion and extending into said output portion for transporting copy sheets between said portions, a billing meter actuated in accordance with the number of copy sheets transported through said copy sheet transport means, means indicating an auxiliary copy sheet transport operation, means normally imposing images on copy sheets being transported in said copy sheet transport means through said copy production portion, and means responsive to said auxiliary indication to inhibit said imposing image means and said billing meter during an auxiliary operation indicated by said auxiliary indication.

32. The machine set forth in claim 31 wherein said copy production portion has means to store partially completed copies, and said auxiliary indication indicating a predetermined transport of said partially completed copies as completed copies from said means to store to said output portion.

* * * * *